US008250835B2

(12) United States Patent
Kenneally

(10) Patent No.: US 8,250,835 B2
(45) Date of Patent: Aug. 28, 2012

(54) THERMALLY INSULATED, COLLAPSIBLE COVER ASSEMBLY AND METHOD OF USING TO TRANSPORT PERISHABLE PRODUCE

(76) Inventor: Keith A. Kenneally, South San Francisco, CA (US)

( * ) Notice: Subject to any disclaimer, the term of this patent is extended or adjusted under 35 U.S.C. 154(b) by 277 days.

(21) Appl. No.: 12/767,106

(22) Filed: Apr. 26, 2010

(65) Prior Publication Data

US 2011/0258972 A1 Oct. 27, 2011

(51) Int. Cl.
*B65B 25/04* (2006.01)

(52) U.S. Cl. ..... 53/440; 53/449; 53/461; 62/457.2; 150/154; 206/205; 206/597; 229/122.3; 229/125.23; 229/198.1; 426/109; 426/419

(58) Field of Classification Search ..... 53/440, 53/447, 449, 452, 456, 457, 461; 62/457.2, 62/530, 60; 150/154; 206/386, 204, 205, 206/597; 426/109, 393, 419, 524; 229/122.3, 229/125.23, 198.1; *B65B 25/02, 25/04*
See application file for complete search history.

(56) References Cited

U.S. PATENT DOCUMENTS

| | | | | | |
|---|---|---|---|---|---|
| 1,735,082 | A * | 11/1929 | Martin, Jr. | ..... | 62/60 |
| 1,843,038 | A * | 1/1932 | McIlvain | ..... | 62/60 |
| 2,302,639 | A * | 11/1942 | Moore | ..... | 62/60 |
| 4,030,600 | A * | 6/1977 | Heaps | ..... | 206/597 |
| 4,868,955 | A * | 9/1989 | Magnant et al. | ..... | 206/597 |
| 4,892,226 | A * | 1/1990 | Abtahi | ..... | 206/204 |
| 5,000,372 | A * | 3/1991 | Hollander et al. | ..... | 206/386 |
| 5,669,233 | A * | 9/1997 | Cook et al. | ..... | 62/457.2 |
| 5,722,328 | A | 3/1998 | Darby | | |
| 5,857,778 | A * | 1/1999 | Ells | ..... | 383/5 |
| 6,041,718 | A * | 3/2000 | Brandes et al. | ..... | 108/51.3 |
| 6,079,560 | A * | 6/2000 | Champion | ..... | 206/386 |
| 6,536,189 | B1 * | 3/2003 | Murray | ..... | 53/440 |
| 7,021,524 | B1 | 4/2006 | Becker et al. | | |
| 7,377,692 | B1 * | 5/2008 | Troncoso et al. | ..... | 150/154 |
| 2001/0006083 | A1 * | 7/2001 | Haberkorn | ..... | 150/154 |
| 2003/0012701 | A1 * | 1/2003 | Sangha et al. | ..... | 62/457.2 |
| 2003/0126882 | A1 * | 7/2003 | Hunter | ..... | 62/457.2 |
| 2006/0243365 | A1 * | 11/2006 | Chiapuzio et al. | ..... | 150/154 |
| 2007/0157653 | A1 | 7/2007 | Sasaki et al. | | |
| 2010/0314397 | A1 * | 12/2010 | Williams et al. | ..... | 53/440 |
| 2011/0180550 | A1 * | 7/2011 | Kenneally | ..... | 53/440 |

FOREIGN PATENT DOCUMENTS

| | | | | | |
|---|---|---|---|---|---|
| JP | 04114881 | A * | 4/1992 | ..... | 206/204 |
| JP | 04128161 | A * | 4/1992 | ..... | 206/204 |
| WO | WO 02074642 | A1 * | 9/2002 | | |
| WO | WO 2008006887 | A1 * | 1/2008 | | |

* cited by examiner

*Primary Examiner* — Stephen F Gerrity
(74) *Attorney, Agent, or Firm* — Charles L. Thoeming

(57) ABSTRACT

An airtight cover assembly includes a side panel folded around goods on a pallet presenting top and bottom opening, a top panel with a plurality of pouches positioned on an inside surface above a vented rigid plate, and a bottom panel encloses the pallet. Hook and loop closures secure the panel assembly. Panel inner and outer surfaces of a poly-vinyl chloride material bonded to an aluminum laminate enclose multiple layers of foam.

9 Claims, 3 Drawing Sheets

THERMALLY INSULATED, COLLAPSIBLE COVER ASSEMBLY AND METHOD OF USING TO TRANSPORT PERISHABLE PRODUCE

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to preserving produce. More particularly, the invention is related to a thermally insulated, collapsible cover assembly used to package and store perishable produce or products during transport by ground, air or sea so as to preserve the temperature of, and prevent heat damage and chill injury to, the produce and/or products while in transit and to deliver the perishable goods at a desired temperature.

BACKGROUND OF THE INVENTION

Several methods and associated apparatus for protecting perishable produce or products during transport have been used including insulated cargo quilts, refrigerated carts, plastic wrapped pallets, vacuum and the like. These methods and related apparatus either include dedicated, one-time use materials or hardware items that are bulky and difficult to return for re-use or re-shipment.

Further, these methods and associated apparatus are limited in the thermal insulation qualities and as such are unsuitable for extended transport logistics which may include off-loading to land based delivery transportation.

The jet pod cover assembly provides an insulated container which is collapsible for after use for protective storage and transport for shipping and reuse. A collapsible insulated jet pod cover assembly breaks down to allow it to be stored or boxed and shipped, by having some or all of the jet pod cover assembly sidewalls and sidewall edges foldable to collapse and fit together with the cover bottom and top portions into a shipping box for return after use. Rigid portions of the jet pod cover assembly likewise are capable of being contained with the jet pod cover assembly bottom and top portions within the shipping box.

A further objective of the jet pod cover assembly is to provide a lightweight and durable produce container capable of keeping product at a desired temperature from point of shipping to point of delivery.

Yet another principal objective of the jet pod cover assembly is to provide an efficient and inexpensive design, from the stand point of both the cost of the materials and the quantity of materials used in manufacture of the jet pod cover assembly. The jet pod cover assembly is also easy to manufacture. Additionally, the jet pod cover assembly is readily assembled such that thermal problems are minimized during set-up and use of the jet pod.

Another objective of the jet pod is to provide a thermally stable cover sized to conveniently and economically house a plurality of produce or product packs arranged in a three-dimensional array upon a wooden pallet to present a 40 inch by 48 inch by 64 inch dimension enclosed within a jet pod cover assembly, and provide uniform thermal stability for the produce packs from a point of shipping the produce or product packs to a point of receiving the produce or product packs.

DISCLOSURE OF INVENTION

A substantially airtight jet pod cover assembly 10 having a base panel 20, a collapsible unitary side panel 24 sized and folded to completely wrap and enclose four sides of a three-dimensional array of produce or product boxes 500 upon a produce or product pallet 510 to form an enclosure with a top opening defined by the side panel top edges, and a bottom opening defined by the side panel bottom edges. A detachable top panel 28 is included; the detachable top panel 28 is sized to correspond to the collapsible unitary side panel 24 top edges and further sized for the top panel edge flaps 30 to enclose the top opening. A detachable base panel 20 is sized to correspond to the collapsible unitary side panel 24 bottom edges and further sized for the base panel edge flaps 54 to enclose the bottom opening.

The unitary side panel 24 includes a plurality of inside surface side panel pouches 26. The detachable top panel 28 further includes a plurality of top panel pouches 40 positioned on a top panel inside surface. The side panel pouches 26 and the top panel pouches 40 are sized to receive correspondingly sized blocks of dry ice 44.

The substantially airtight jet pod cover assembly 10 detachable top panel 28 further includes a rigid top plate 32 having a plurality of vent openings 36 through the rigid top plate 32 corresponding to pouches 40 positioned on the detachable top panel 28 inside surface and sized to be located inside the substantially airtight jet pod cover assembly 10 under the detachable top panel 28 inside surface. A hook and loop closure 50 on four top edges of the collapsible unitary side panel 24 and corresponding four top panel edge flaps 30 allows the jet pod cover assembly 10 top opening to be closed upon the produce or product boxes 500. A hook and loop closure 22 on four bottom edges of the collapsible unitary side panel 24 and corresponding four base panel edge flaps 54 allows the jet pod cover assembly 10 bottom opening to be closed upon the produce or product boxes 500 and produce or product pallet 510. Each corner of the detachable top panel 28 closure between the detachable top panel and collapsible unitary side panel has a corner closure seal 58. Each corner of the detachable base panel 20 closure between the detachable base panel and collapsible unitary side panel has a corner closure seal 58.

The detachable base panel 20, the collapsible unitary side panel 24, and the detachable top panel 28 include inner surfaces 16 and outer surfaces 12 of a poly-vinyl chloride material bonded to an aluminum laminate with multiple layers of foam 14 interposed between the inner surfaces 16 and outer surfaces 12.

BRIEF DESCRIPTION OF DRAWINGS

The above stated features, aspects, and advantages of the jet pod cover assembly will become better understood with regard to the following description and accompanying drawings as further described.

Figure 1:
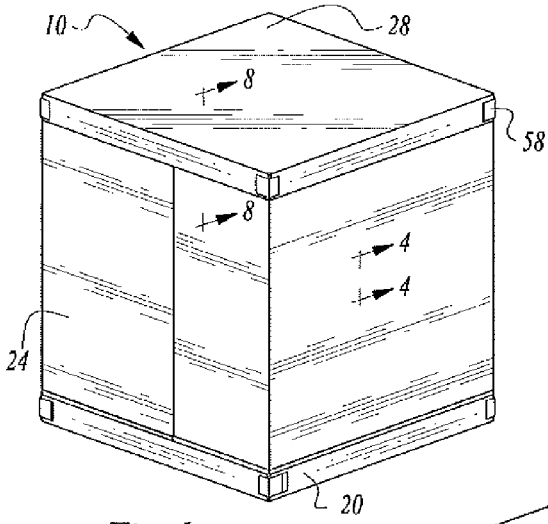
FIG. 1 is a perspective view of an embodiment of jet pod cover assembly 10 depicting the detachable top panel 28 closed onto the top of the collapsible unitary side panel 24, and further depicting the detachable base panel 20 closed onto the bottom of the collapsible unitary side panel 24.
Figure 2:
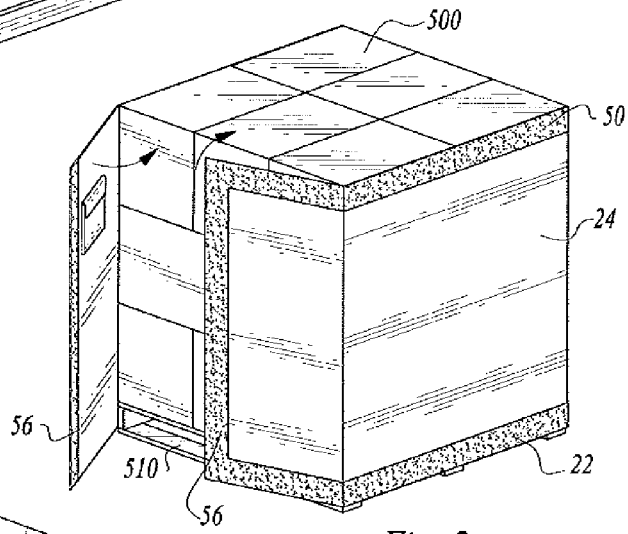

FIG. 2 is a perspective view of the embodiment of jet pod cover assembly 10 of FIG. 1, with the detachable top panel 28 and the detachable base panel 20 removed, and depicting the collapsible unitary side panel 24 enclosing product or produce boxes 500 stacked onto a product or produce pallet 510.

Figure 3:
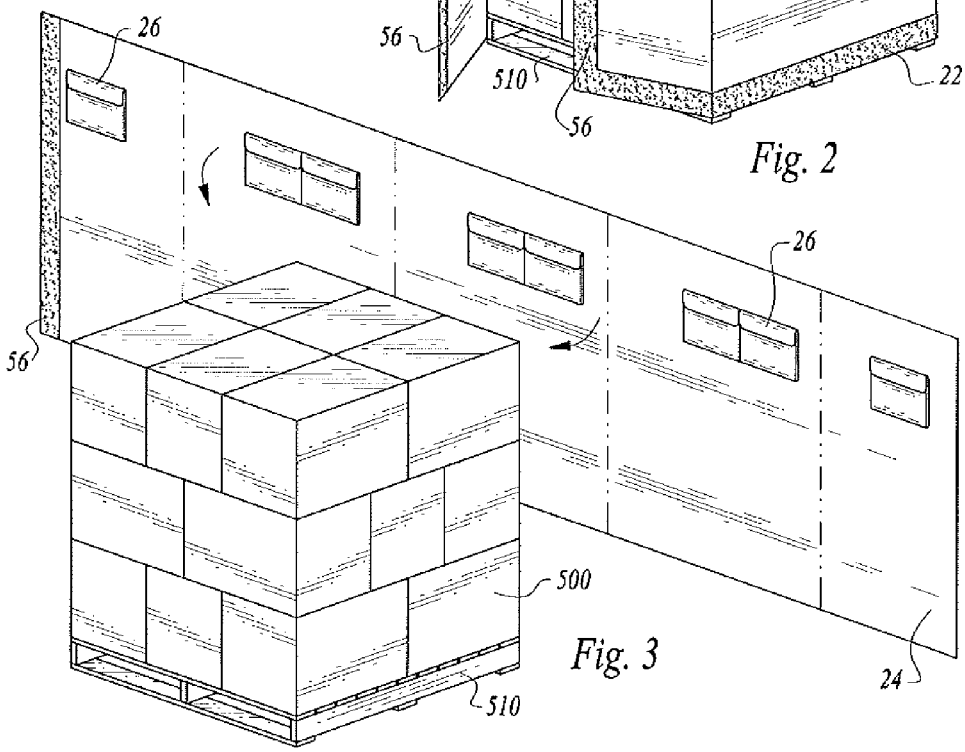

FIG. 3 is a perspective view of the embodiment of jet pod cover assembly 10 of FIG. 2 depicting the collapsible unitary side panel 24 removed from the product or produce boxes 500 stacked onto a product or produce pallet 510.

Figure 4:
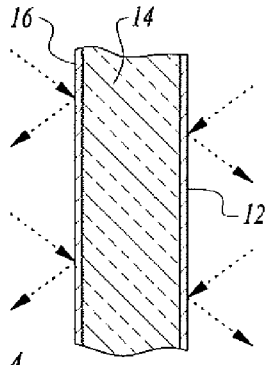

FIG. 4 is a detailed sectional view of FIG. 1 taken at "4-4."

Figure 5:
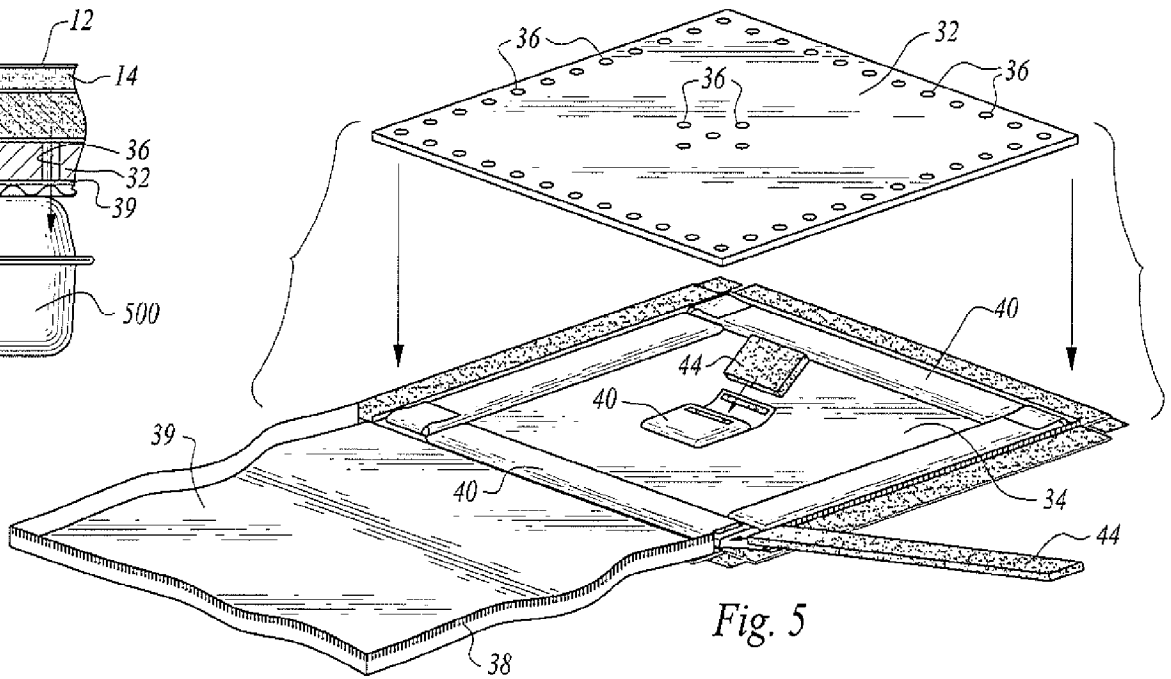

FIG. 5 is an exploded perspective bottom view of the detachable top panel 28 depicting the top panel compartment 34 open to allow insertion of blocks of dry ice 44 into the top pouches 40 and the top panel rigid plate 32 sized to fit within the top panel compartment 34 by zipper closure 38 of the permeable inside surface 39.

Figure 6:
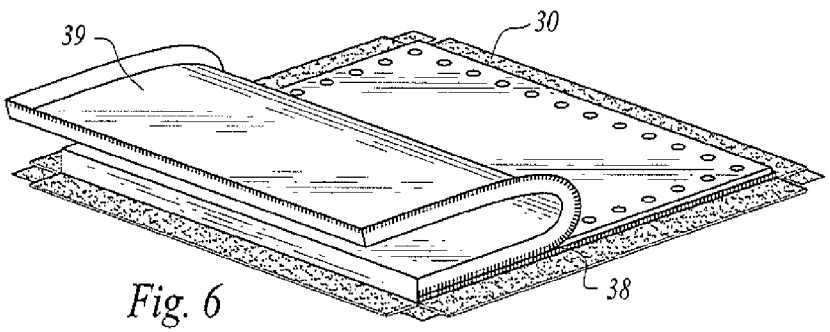

FIG. 6 is a perspective bottom view of the embodiment of the detachable top panel 28 of FIG. 5 depicting closure of the top panel compartment 34 by zipper closure 38 of the permeable inside surface 39.

Figure 7:
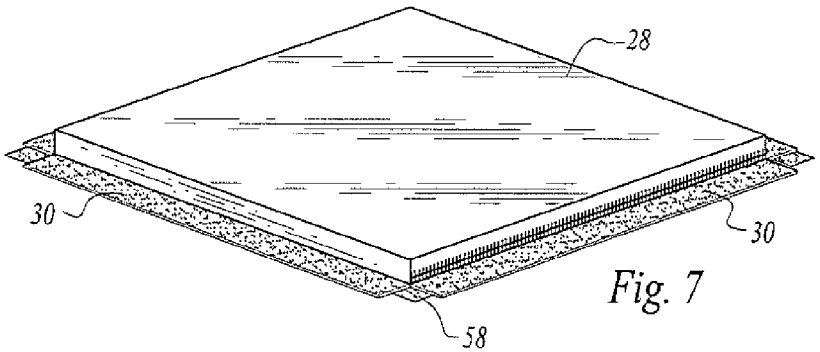
Figure 9:
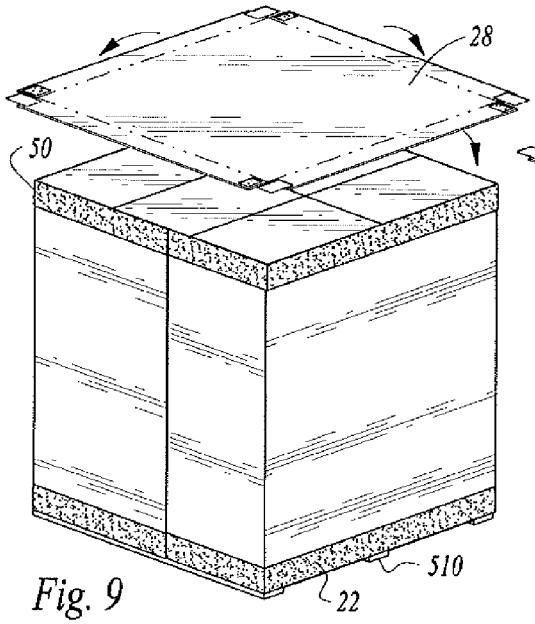
Figure 10:
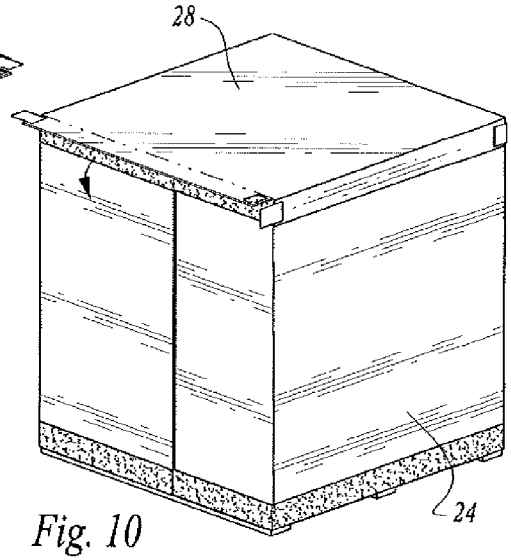
Figure 14:
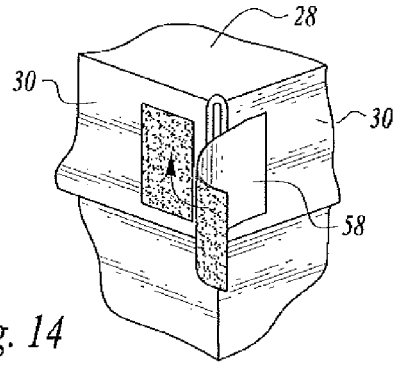

FIG. 7 is a perspective bottom view of an embodiment of the detachable top panel 28 of FIG. 6 depicting the detachable top panel closed and ready to cover the top opening of the jet pod cover assembly 10 of FIGS. 2 and 9, by closure of the hook and loop top panel edge flaps 30 with collapsible unitary side panel 24 top edge hook and loop closures 50 of FIGS. 9-10, and 14.

Figure 8:
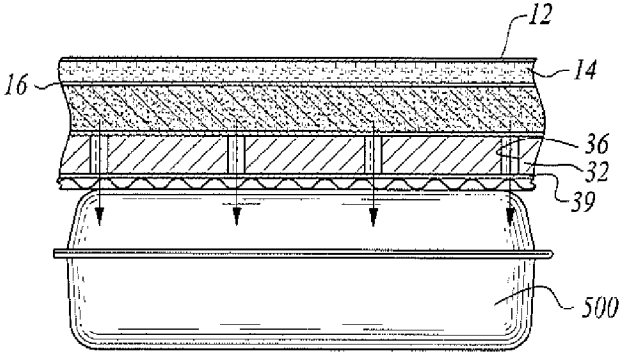

FIG. 8 is a detailed sectional view of FIG. 1 taken at "8-8."

FIG. 9 is a perspective view of the embodiment of jet pod cover assembly 10 of FIG. 2 depicting the closure of the collapsible unitary side panel 24 and the detachable top panel 28 positioned to attach to the closure 50 between the top detachable top panel and the unitary side panel.

FIG. 10 is a perspective view of the embodiment of jet pod cover assembly 10 of FIG. 2 depicting the closure of the collapsible unitary side panel 24 and the detachable top panel edge flaps 30 being affixed to the closure 50 between the detachable top panel and the top of the unitary side panel.

Figure 11:
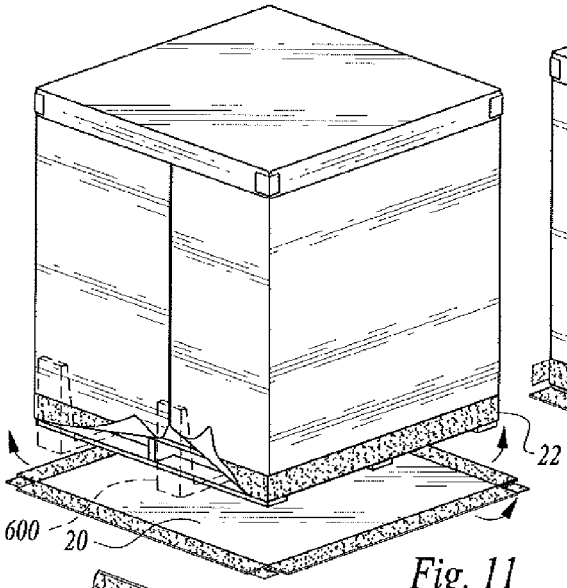

FIG. 11 is a perspective view of the embodiment of jet pod cover assembly 10 of FIG. 10 depicting the closure of the collapsible unitary side panel 24 and the detachable base panel 20 positioned to attach to the closure 22 between the detachable base panel and the bottom of the unitary side panel, and further depicting partial opening of the closure 56 of the collapsible side panel for positioning forklift arms 600 into the produce or product pallet 510.

Figure 12:
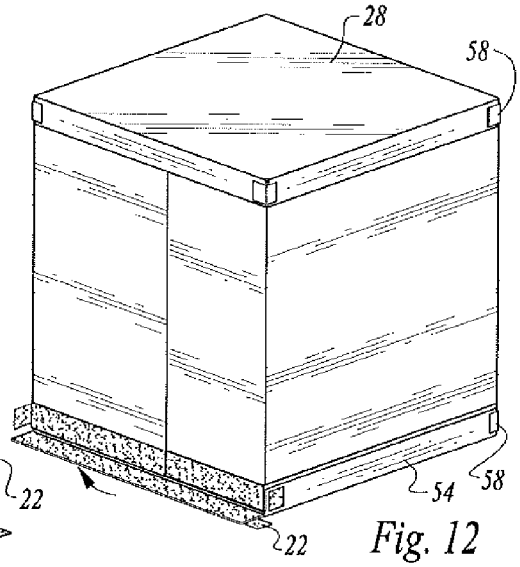

FIG. 12 is a of the embodiment of jet pod cover assembly 10 of FIG. 11 depicting the closure of the collapsible unitary side panel 24 and the detachable base panel edge flaps 54 being affixed to the closure 22 between the detachable base panel and the bottom of the unitary side panel.

Figure 13:
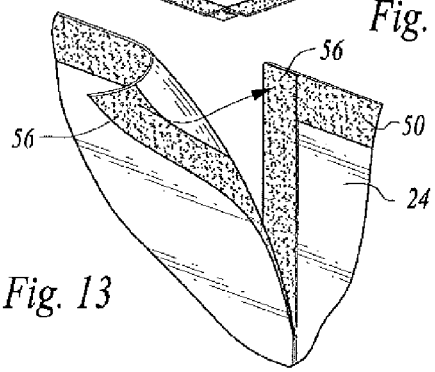

FIG. 13 is a detailed view of the closure of the collapsible unitary side panel 24 of the embodiment of jet pod cover assembly 10 of FIG. 2.

FIG. 14 is a detailed view of the corner closure seal of the detachable top panel edge flaps 30 of FIG. 10, after closure of the hook and loop top panel edge flaps 30 with collapsible unitary side panel 24 top edge hook and loop closures 50.

BEST MODE FOR CARRYING OUT THE INVENTION

Referring more specifically to the drawings, for illustrative purposes the jet pod cover assembly 10 is embodied generally in FIGS. 1-14. It will be appreciated that the jet pod may vary as to configuration and as to the details of the parts, and that the method of using the jet pod cover assembly 10 may vary as to details and to the order of steps, without departing from the basic concepts as disclosed herein. The jet pod cover assembly 10, and a system and method of use thereof, are disclosed generally. However, the disclosed jet pod cover assembly 10, plus the system and method for using the jet pod cover assembly 10, may be used in a variety of applications, as will be readily apparent to those skilled in the art.

A method of packaging and preserving produce or product for air transport includes the steps of: a) packing the produce or product in a substantially airtight jet pod cover assembly 10 container in which the produce is to be transported at the point of transfer; and b) providing means for maintaining the temperature of the produce or product in the jet pod cover assembly 10 container to the point of delivery. Once the jet pod cover assembly 10 has been unpacked at the point of delivery, the jet pod cover assembly 10 can be collapsed and packed for ease in delivery back to the point of transfer for reuse.

The method is practiced by further providing the substantially airtight jet pod cover assembly 10. An embodiment of the method includes an airtight jet pod cover assembly 10 which includes, in combination a detachable base panel 20, a collapsible unitary side panel 24, and a detachable top panel 28, for example, FIG. 1. Each of these three panels, the detachable base panel 20, the collapsible unitary side panel 24, and the detachable top panel 28, has inner surfaces 16 and outer surfaces 12 including a poly-vinyl chloride material bonded to an aluminum laminate and further include multiple layers of foam 14 interposed between the inner 16 and outer surfaces 12, for example, FIG. 4. The combination of insular layers of foam 14 between poly-vinyl chloride bonded aluminum laminate inner surfaces 16 and outer surfaces 12 enhance protection of the products or fresh produce from the risks of airborne contaminants, moisture, bacteria, harmful pathogens, and heat damage presented by air, ground or sea transit.

The collapsible unitary side panel 24 is sized and folded to form an enclosure around all four sides of an array product or produce boxes 500 on a product or produce pallet 510, for example, FIGS. 2 and 3. The collapsible unitary side panel 24 enclosure around the product or produce boxes 500 on a product or produce pallet 510 provides a substantially square top opening defined by and bounded by the collapsible unitary side panel 24 top edges and a substantially square bottom opening defined by and bounded by the collapsible unitary side panel 24 bottom edges, for example, FIGS. 2 and 3. The collapsible unitary side panel 24 top edges and the collapsible unitary side panel 24 bottom edges include hook and loop closures, 50 and 20, respectively, for example, FIG. 3. The collapsible unitary side panel 24 end edges have hook and loop closures 56 on opposing sides to facilitate closing the collapsible unitary side panel 24 around all four sides of an array product or produce boxes 500 on a product or produce pallet 510, for example, FIGS. 2 and 3.

The detachable top panel 28 is sized to correspond to the collapsible unitary side panel 24 top edges and further sized for the top panel 28 edges to enclose the top opening, for example, FIGS. 2 and 9, to close the top opening defined by the collapsible unitary side panel 24 top edges. The substantially airtight jet pod cover assembly 10 detachable top panel 28 further includes a rigid top plate 32 having a plurality of vent openings 36 through the rigid top plate 32 corresponding to pouches 40 positioned on the detachable top panel 28 inside surface top panel compartment 34 and sized to be located inside the substantially airtight jet pod cover assembly 10 under the detachable top panel 28 inside surface, for example, FIGS. 5-8. An embodiment of the jet pod cover assembly 10 detachable top panel 28 provides a permeable inside surface 39 that is closed over the top panel compartment 34 by zipper closure 38, FIG. 6. The permeable inside surface 39 provides cool air from the dry ice 44 in the top panel compartment 34 pouches 40 to flow into the enclosed, substantially airtight jet pod cover assembly 10 housing the produce or product boxes 500, FIG. 8. A hook and loop attachment closure 50 on four top edges of the collapsible unitary side panel 24 and corresponding four top panel edge flaps 30 allows the jet pod cover assembly 10 top opening to be closed upon the produce or product boxes 500, for example, FIGS. 1, 9-10, and 14, by folding the four top panel edge flaps 30 to extend orthogonally downward from the top panel.

A preferred embodiment of the substantially airtight jet pod cover assembly 10 includes a base panel 20, a collapsible unitary side panel 24 sized and folded to completely wrap and enclose four sides of a 40 inch by 48 inch by 64 inch dimension provided by an array of produce or product boxes 500 upon a produce or product pallet 510 with a detachable base panel 20 to form an enclosure with a top opening defined by the side panel top edges, and a bottom opening defined by the side panel bottom edges. A hook and loop attachment closure 22 on four bottom edges of the collapsible unitary side panel 24 and corresponding four base panel edge flaps 54 allows the jet pod cover assembly 10 bottom opening to be closed upon the produce or product boxes 500 and produce or product pallet 510, for example FIGS. 1-3, 11-14, to close the bottom opening defined by the collapsible unitary side panel 24 bottom edges by folding the four bottom panel edge flaps 54 to extend orthogonally upward from the bottom panel. Releasing the base panel edge flap 54 corresponding to the unitary side panel 24 end edges hook and loop closure 56 seam, and opening the bottom of the unitary side panel 24 seam, permits forklift arms 600 temporary access to reposition the produce or product pallet 510, for example, FIGS. 11 and 12. Once the produce or product pallet 510 is repositioned and the forklift arms 600 are withdrawn from the pallet, the unitary side panel 24 seam bottom is re-sealed, and the base panel edge flap 54 corresponding to the unitary side panel 24 end edges hook and loop attachment closure 56 seam is resealed to the unitary side panel 24 bottom to maintain the substantially airtight jet pod cover assembly 10 controlled internal temperature.

The unitary side panel 24 includes a plurality of inside surface side panel pouches 26, for example, FIG. 3. The detachable top panel 28 further includes a plurality of top panel pouches 40 positioned on a top panel inside surface, for example, FIG. 5. The side panel pouches 26 and the top panel pouches 40 are sized to receive at least one correspondingly sized block of dry ice 44, for example, FIG. 5. Embodiments of the jet pod cover assembly 10 include pouches 26 and 40 having side constructed of mesh material to enhance the flow of cold air to vent over the produce or product boxes 500 within the substantially airtight jet pod cover assembly 10.

Each corner of the detachable top panel 28 closure between the detachable top panel and collapsible unitary side panel has a corner closure seal 58, for example, FIGS. 1, 12, and 14. Each corner of the detachable base panel 20 closure between the detachable base panel and collapsible unitary side panel has a corner closure seal 58, for example, FIGS. 1 and 12. The detail depicted, for example in FIG. 14, for the detachable top panel 28 corner closure seal 58 is understood to be applicable also for the detachable base panel 20 corner closure seal 58, for example, FIGS. 1 and 12. The preferred embodiment of corner closure seal 58 includes at least one hook and loop attachment closure assembly.

Therefore, the foregoing is considered as illustrative only of the principles of the apparatus, system and method for a refrigerated shipping container used to package and store perishable goods during transport by ground, air or sea so as to preserve the temperature of, and prevent heat damage and chill injury to, the goods while in transit. Additionally, since numerous modifications and changes will readily occur to those skilled in the art, it is not desired to limit the apparatus, system and method for a refrigerated shipping container used to package and store perishable goods during transport by ground, air or sea so as to preserve the temperature of, and prevent heat damage and chill injury to, the goods while in transit to the exact construction and operation shown and described, and further, all suitable modifications and equivalents may be resorted to, falling within the scope of the disclosed apparatus, system and method.

I claim:

1. A method of packaging and preserving produce for air transport, the method comprising the steps of:

a) folding a collapsible unitary side panel, sized to be folded around and enclose the sides of a substantially cubic three dimensional array of filled produce boxes on a pallet, around the substantially cubic three dimensional array of filled produce boxes on a pallet, defining a substantially square top opening bounded by the collapsible unitary side panel top edges and further defining a substantially square bottom opening bounded by the collapsible unitary side panel bottom edges, the collapsible unitary side panel comprising means for hook and loop attachment on an outside surface of the collapsible unitary side panel top edges and bottom edges, means for hook and loop attachment on an outside end of the collapsible unitary side panel and a corresponding inside end of the collapsible unitary side panel, and a plurality of pouches on a collapsible unitary side panel inside surface;

b) closing the collapsible unitary side panel top opening with a detachable top panel, sized to correspond to the collapsible unitary side panel top edges, the detachable top panel comprising four corners, flaps sized and folded on an edge to extend orthogonally downward from the top panel, means for hook and loop attachment on an inside surface of each flap, a flap corner seal on each detachable top panel corner, a compartment further comprising a plurality of pouches, and a permeable surface having a zippered enclosure for the compartment;

c) locating a rigid top plate inside the detachable top panel enclosed zippered compartment, the rigid top plate comprising a plurality of vent openings through the top plate corresponding to the position of pouches positioned on a compartment inside surface, wherein the pouches are positioned above the rigid top plate in relation to the array of boxes on the pallet;

d) closing the unitary side panel bottom opening with a detachable base panel sized to correspond to the collapsible unitary side panel bottom edges, the detachable base panel comprising four corners, flaps sized and folded on an edge to extend orthogonally upward from the base panel, means for hook and loop attachment on an inside flap surface, and a flap corner seal on each detachable base panel corner, whereby a reusable, substantially airtight container to transport the non-frozen produce is obtained; and e) providing means for maintaining the temperature of the produce in the reusable, substantially airtight container to a point of delivery.

2. The method of claim 1 further comprising the steps of:

a) releasing a base panel edge flap corresponding to a unitary side panel closure seam, b) opening the bottom of the unitary side panel closure seam to permit mechanized and transportable lift arms access to the pallet;

c) transporting the reusable, substantially airtight container to a desired position by the mechanized and transportable lift arms; and d) removing the mechanized and transportable lift arms from the pallet;

e) closing the bottom of the unitary side panel closure seam; and re-attaching the base panel edge flap corresponding to the unitary side panel closure seam.

3. The method of claim 1 wherein the detachable base panel, the collapsible unitary side panel, and the detachable top panel further comprise inner and outer surfaces comprising a poly-vinyl chloride material bonded to an aluminum laminate and further comprising multiple layers of foam interposed between the inner and outer surfaces.

4. The method of claim 1 further comprising the steps of:

a) detatching the detachable top panel and detachable base panel from the unitary side panel of the reusable, substantially airtight container after the container has been emptied at the point of delivery;

b) detaching the ends of the unitary side panel one from the other;

c) removing the unitary side panel from the pallet;

c) collapsing and folding the unitary side panel into a square substantially the size of the detachable top panel and the detachable base panel;

b) packing the collapsed and folded unitary side panel, detachable top panel, and the detachable base panel into a shipping container for delivery back to a point of transfer for reuse.

5. The method of claim 1, wherein providing means for maintaining the temperature of the produce in the reusable, substantially airtight container to a point of delivery comprises placing blocks of dry ice in the detachable top panel pouches and the collapsible unitary side panel pouches.

6. A collapsible insulated container comprising:

a) a collapsible unitary side panel sized to be folded around and enclose the sides of an array of produce or product boxes on a pallet, the resulting enclosing side panel defining a substantially square top opening bounded by the collapsible unitary side panel top edges and further defining a substantially square bottom opening bounded by the collapsible unitary side panel bottom edges, the collapsible unitary side panel comprising means for hook and loop attachment on an outside surface of the collapsible unitary side panel top edges and bottom edges, means for hook and loop attachment on an outside end of the collapsible unitary side panel and the corresponding inside end of the collapsible unitary side panel, and a plurality of pouches on a collapsible unitary side panel inside surface;

b) a detachable top panel sized to correspond to the collapsible unitary side panel top edges, such that the detachable top closes the collapsible unitary side panel top opening, the detachable top panel comprising four corners, flaps sized and folded on an edge to extend orthogonally downward from the top panel, means for hook and loop attachment on an inside surface of each flap, a flap corner seal on each detachable top panel corner, a compartment further comprising a plurality of pouches, and a permeable surface having a zippered enclosure for the compartment;

c) a rigid top plate having a plurality of vent openings through the top plate corresponding to the position of pouches positioned on a compartment inside surface, the rigid top plate sized to be located inside the detachable top panel enclosed zippered compartment, wherein the pouches are positioned above the rigid top plate in relation to the array of boxes on the pallet; and d) a detachable base panel sized to correspond to the collapsible unitary side panel bottom edges, such that the detachable base closes the collapsible unitary side panel bottom opening, the detachable base panel comprising four corners, flaps sized and folded on an edge to extend orthogonally upward from the base panel, means for hook and loop attachment on an inside flap surface, and a flap corner seal on each detachable base panel corner.

7. The container of claim 6, wherein the detachable base panel, the collapsible unitary side panel, and the detachable top panel further comprise inner and outer surfaces comprising a poly-vinyl chloride material bonded to an aluminum laminate and further comprising multiple layers of foam interposed between the inner and outer surfaces.

8. The container of claim 7, wherein the detachable top panel pouches and the collapsible unitary side panel pouches comprise blocks of dry ice size for each pouch.

9. Apparatus to package and store perishable goods during transport to preserve the temperature of, and prevent heat damage and chill injury to, the goods while in transit, the apparatus comprising, in combination:

a) a collapsible unitary side panel sized to be folded around to enclose the sides of an array of produce or product boxes on a pallet, the resulting enclosing side panel defining a substantially square top opening bounded by the collapsible unitary side panel top edges and further defining a substantially square bottom opening bounded by the collapsible unitary side panel bottom edges, comprising means for hook and loop attachment on an outside surface of the collapsible unitary side panel top edges and bottom edges, means for hook and loop attachment on an outside end of the collapsible unitary side panel and the corresponding inside end of the collapsible unitary side panel, and a plurality of pouches on a collapsible unitary side panel inside surface;

b) a detachable top panel sized to correspond to the collapsible unitary side panel top edges, such that the detachable top closes the collapsible unitary side panel top opening, the detachable top panel comprising four corners, flaps sized and folded on an edge to extend orthogonally downward from the top panel, means for hook and loop attachment on an inside surface of each flap, a flap corner seal on each detachable top panel corner, a compartment further comprising a plurality of pouches, and a permeable surface having a zippered enclosure for the compartment;

c) a rigid top plate having a plurality of vent openings through the top plate corresponding to the position of pouches positioned on a compartment inside surface, the rigid top plate sized to be located inside the detachable top panel enclosed zippered compartment, wherein the pouches are positioned above the rigid top plate in relation to the array of boxes on the pallet; and d) a detachable base panel sized to correspond to the collapsible unitary side panel bottom edges, such that the detachable base closes the collapsible unitary side panel bottom opening, the detachable base panel comprising four corners, flaps sized and folded on an edge to extend orthogonally upward from the base panel, means for hook and loop attachment on an inside flap surface, and a flap corner seal on each detachable base panel corner;

wherein the detachable base panel, the collapsible unitary side panel, and the detachable top panel further comprise inner and outer surfaces comprising a poly-vinyl chloride material bonded to an aluminum laminate and further comprising multiple layers of foam interposed between the inner and outer surfaces; and wherein blocks of dry ice are contained in the detachable top panel pouches and the collapsible unitary side panel pouches.

* * * * *